United States Patent [19]

Nourie

[11] Patent Number: 4,739,782

[45] Date of Patent: Apr. 26, 1988

[54] POWER SPRAY PARTS WASHING MACHINE

[76] Inventor: Robert L. Nourie, 640 Aljo Dr., Pittsburgh, Pa. 15241

[21] Appl. No.: 46,677

[22] Filed: May 7, 1987

[51] Int. Cl.[4] ..... B08B 3/02; B08B 13/00

[52] U.S. Cl. ..... 134/140; 68/210; 134/153; 134/160; 134/161

[58] Field of Search ..... 134/134, 135, 140, 153, 134/157, 160, 161; 68/210

[56] References Cited

U.S. PATENT DOCUMENTS

| | | | |
|---|---|---|---|
| 850,061 | 4/1907 | Seifert | 68/210 |
| 1,128,722 | 2/1915 | Renisch | 134/157 X |
| 1,210,853 | 1/1917 | Schettler | 68/210 X |
| 2,986,918 | 6/1961 | Widigen | 68/210 |
| 3,487,840 | 1/1970 | Stenzel et al. | 134/153 X |

*Primary Examiner*—Philip R. Coe

*Attorney, Agent, or Firm*—William J. Ruano

[57] ABSTRACT

Power spray parts washing machine having mounted therein a perforated rotating drum which rotates on a horizontal axis and is provided with air operated means for projecting a door of the drum outwardly of the door opening of the machine for loading or unloading the parts into the drum. Sprays of hot water containing detergent are located above and below the drum.

2 Claims, 1 Drawing Sheet

POWER SPRAY PARTS WASHING MACHINE

This invention relates to a power spray parts washing machine for washing metal and plastic parts of various shapes.

BACKGROUND OF THE INVENTION

Parts washing machines have been provided with a flat basket which rotated in a horizontal plane onto which sprays of washing fluid would be applied to the parts to be washed. Since many such parts have cup-shapes and are rather small, therefore not leading themselves to washing in such basket, this mode of washing has not been satisfactory for such parts.

SUMMARY OF THE INVENTION

An object of the invention is to overcome the above-named disadvantage by providing a rotary drum fixture inside the power spray parts washing machine which can be easily loaded and moved into the washing machine and unloaded by moving the drum out of the washing machine to enable such parts to be easily handled and at the same time rotated at a slow rate during a washing operation in a manner so as to thoroughly wash and drain the parts contained in the rotating drum fixture. Thus there is only one drum in the machine at a time and the drum can be brought out to a load position and indexed back into the machine for the cleaning operation.

BRIEF DESCRIPTION OF THE DRAWING

Referring more particularly to the drawing.

DESCRIPTION OF THE PREFERRED EMBODIMENT

Figure 2:
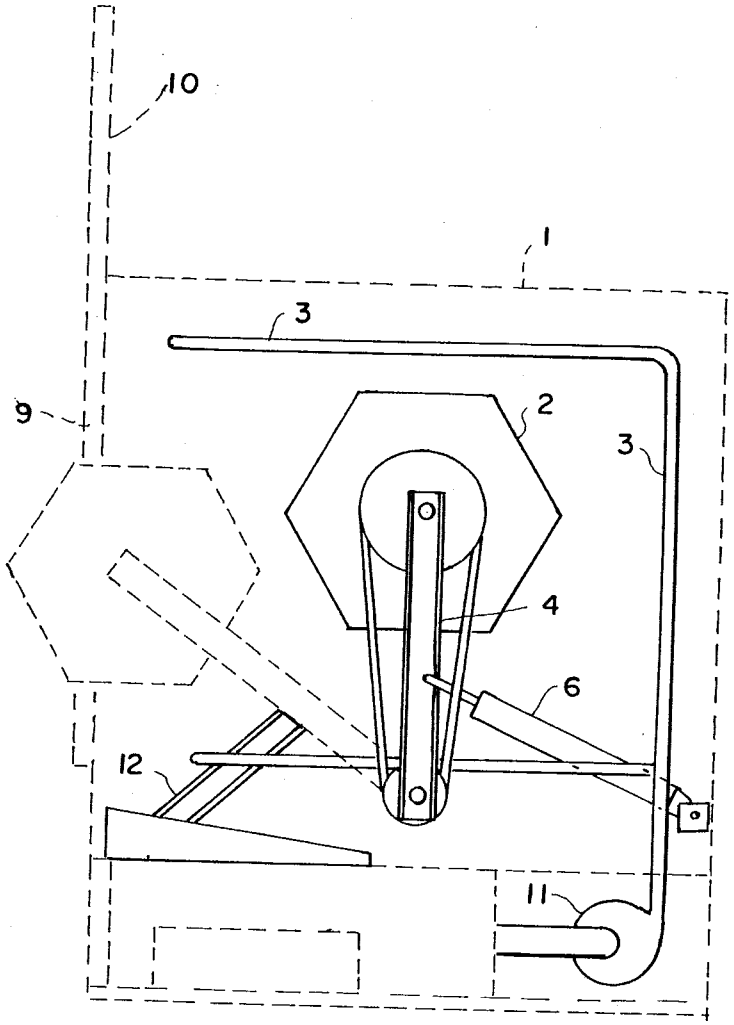
FIG. 2 is a side view of the right of the machine showing the loading door 10 open and the drum fixture moved partially outwardly of the door for loading or unloading the parts.
Figure 1:
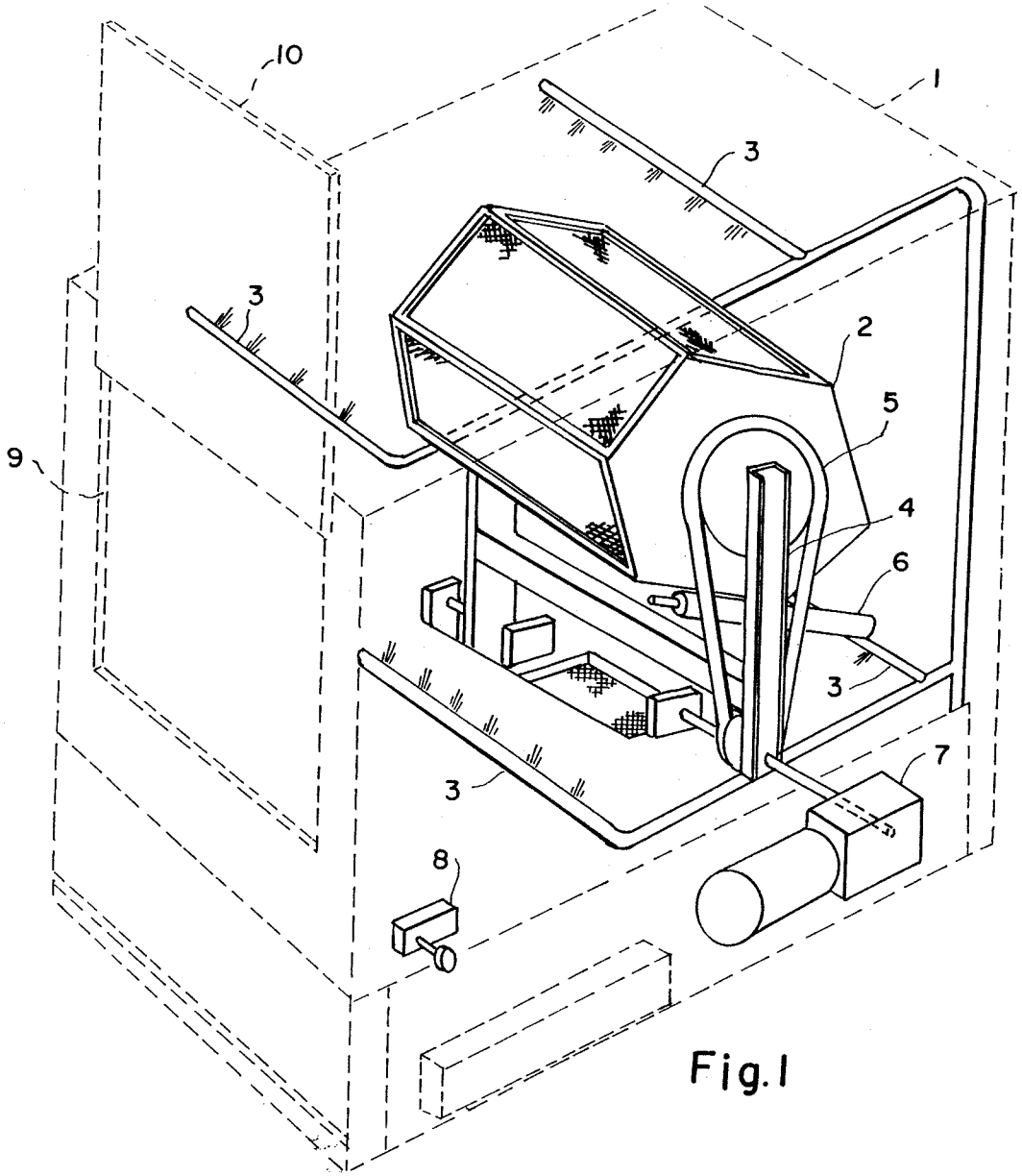
FIG. 1 shows a perspective view of the invention as seen from the top right side of the machine.

Referring to FIGS. 1 and 2 of the drawing, the standard parts washing cabinet and frame 1 is equipped with a pneumatically operated door 10 on the front of the machine for easy access through opening 9 when the rotating drum fixture 2 is moved to the dotted line position for easy access for loading and unloading the parts in the drum. Such drum or basket is perforated or made of wire mesh or of expanded metal sides to contain the parts while they are rotated during the washing cycle. The drum fixture has a door on one side for removal or loading of the parts to be cleaned.

The rotating drum fixture is rotatably mounted on a structural steel frame 4 and connected by means of a chain and sprocket drive 5 to a motor and gear reducer 7 which automatically and slowly rotates the drum 2 and parts during the washing cycle.

While the parts are being washed, detergent and hot water will be pumped by pump 11 (FIG. 2) through piping and spray headers 3 with spray directed at the rotating drum fixture to wash away dirt with hot water and detergent under pressure.

At the completion of the washing cycle, door 10 automatically opens to the position shown in FIG. 2 and the rotating drum 2 stops. The operator actuates the manual air valve 8 which actuates air cylinder 6 attached to the structural frame 4 holding the rotary drum. This moves the drum to the position indicated in dash outline for loading and unloading. The drum and structural frame are supported in this position on the structural front stop 12.

When the basket or drum has been reloaded with parts to be cleaned, the operator again actuates valve 8 and the basket and frame are pulled into the machine for the proper operating position by the air actuated cylinder 6. The pueumatic vertical door 10 is then closed and the automatic wash cycle is initiated.

The washing cycle is automatically timed by a preset timer of any well known construction. At the completion of the wash cycle, the above operation is completed.

Thus it will be seen that we have provided a novel rotating drum fixture and mounting in a cabinet style power spray parts washing machine which washes metal and plastic parts of numerous shapes more thoroughly than ever before and which makes loading and unloading of the parts very easy by projecting the rotating drum outside the cabinet, either for unloading or loading after the door is automatically opened. Moreover, the parts may be thoroughly cleaned in less time by applying less detergent and hot water thereon. Also, I have provided sprays for spraying water both above and below the drum as it is being rotated.

While I have illustrated and described a single embodiment of the invention, modification will become readily apparent to those of ordinary skill in the art which may be within the scope of the present invention.

I claim:

1. A cabinet type power spray, parts washing machine comprising a cabinet having a door, a motor and gear reducer having a drive shaft, a metallic frame in said cabinet having a lower end, said drive shaft extending through said lower end for pivotally mounting said metallic frame, a perforated drum of polygonal shape in said cabinet for containing parts to be sprayed, said drum pivotally supported on the upper end of said metallic frame, a chain and sprocket drive between said drive shaft and drum, a rectangular perforated door forming one of the sides of said drum, piping including spray headers extending above and below said drum for spraying said parts in said drum, a fluid cylinder having a stationary pivotal end and a movable end pivotally connected intermediate said metallic frame, which cylinder, when energized will selectively move said drum exteriorly, in part, through said cabinet door, when opened, to enable access to said door of said drum or interiorly of said cabinet for washing.

2. A machine as recited in claim 1 together with stop means for limiting the extent of pivoting of said metallic frame when pivotally moving said drum exteriorly, in part, of said cabinet.

* * * * *